US006164014A

United States Patent [19]

McDowell et al.

[11] Patent Number: 6,164,014

[45] Date of Patent: Dec. 26, 2000

[54] CABLE CONTROL DEVICE FOR SECTIONAL OVERHEAD DOOR

[75] Inventors: Allen C. McDowell, Pensacola; Willis J. Mullet, Pensacola Beach, both of Fla.

[73] Assignee: Wayne-Dalton Corp., Mt. Hope, Ohio

[21] Appl. No.: 09/169,887

[22] Filed: Oct. 12, 1998

[51] Int. Cl.[7] ..... E05F 11/00; E05F 15/00; E05F 13/00

[52] U.S. Cl. ..... 49/200; 49/197; 49/199; 160/191

[58] Field of Search ..... 49/199, 197, 200; 160/191, 201, 188, 170 R

[56] References Cited

U.S. PATENT DOCUMENTS

| | | | |
|---|---|---|---|
| 2,020,831 | 11/1935 | Greegor | 20/20 |
| 2,314,015 | 3/1943 | Parsons | 16/198 |
| 3,038,535 | 6/1962 | Stroup et al. | 160/191 |
| 3,160,200 | 12/1964 | McKee et al. | 160/189 |
| 3,224,492 | 12/1965 | Houk | 160/189 |
| 4,191,237 | 3/1980 | Voege | 160/188 |
| 4,882,806 | 11/1989 | Davis | 16/198 |
| 5,025,591 | 6/1991 | De Land et al. | 49/360 |
| 5,419,010 | 5/1995 | Mullet | 160/191 X |
| 5,557,887 | 9/1996 | Fellows et al. | 49/28 |
| 5,636,678 | 6/1997 | Carper et al. | 160/191 |
| 5,803,149 | 9/1998 | Halley et al. | 160/201 |
| 5,865,235 | 2/1999 | Krupke et al. | 160/191 |

FOREIGN PATENT DOCUMENTS

| | | | |
|---|---|---|---|
| 0 716 203 A1 | 6/1996 | European Pat. Off. | E05F 15/16 |

*Primary Examiner*—Alvin Chin-Shue
*Assistant Examiner*—Hugh B. Thompson
*Attorney, Agent, or Firm*—Renner, Kenner, Greive, Bobak, Taylor & Weber

[57] ABSTRACT

A cable control device (10) for a sectional overhead door (11) having a motor-driven counterbalance system (30) including, a spring-loaded drive shaft (31), cable drums (33) carried by the drive shaft, cables (C) attached to and interconnecting the cable drums and the door and forming and releasing cable wraps on the cable drums upon raising and lowering of the door, and retainers (60) associated with the cable drums engaging a portion of at least one cable wrap to maintain engagement of the cable wrap with the cable drums in the event of the development of slack in the cables.

7 Claims, 4 Drawing Sheets

CABLE CONTROL DEVICE FOR SECTIONAL OVERHEAD DOOR

TECHNICAL FIELD

The present invention relates generally to a cable control device for a sectional overhead door. More particularly, the present invention relates to a cable control device for a motor-driven counterbalance system for a sectional overhead door that maintains control of the cable orientation with respect to the cable drums in the event of the development of slack in the cables during the operating cycle of the door. More specifically, the present invention relates to a cable control device for a motor-driven counterbalance system for a sectional overhead door wherein the cable wraps formed on the cable drums during raising and lowering of the door are controlled by retainers associated with the cable drums, which control the positioning of a cable wrap to prevent displacement of the cable from engagement with the cable drums about which the cable is reeved under operating conditions when slack develops in the cables.

BACKGROUND ART

Counterbalancing systems for sectional overhead doors have commonly employed torsion spring arrangements. The use of torsion springs in such sectional overhead doors is, in significant part, because the linear tension characteristics of a torsion spring can be closely matched to the substantially linear effective door weight as a sectional door moves from the open, horizontal position where the door is largely track supported to the closed, vertical position or vice versa. In this manner, the sum of the forces acting on such a sectional garage door may be maintained relatively small except for momentum forces generated by movement of the door by the application of manual or mechanical forces. In this respect, sectional overhead doors have been provided with lift cables or similar flexible elements attached to the bottom of the door and to cable storage drums at the ends of a drive tube, which rotate when the drive tube is actuated.

In many cases, these cable storage drums have surface grooves that guide the lift cables on and off of the cable storage drum to prevent the coils or cable wraps from rubbing against each other and chafing if positioned in side-by-side engaging relationship or if coiled on top of each other. Lift cables sized to meet operational requirements for sectional overhead door applications are commonly constructed of multiple strand steel filaments that have a pronounced resistance to bending when stored on the circumference of the cable drums and, thus, require tension to remain systematically coiled or wrapped about the cable drums in the grooves therein.

A problem arises if tension is removed from one or both of the lift cables of a sectional overhead door in that the lift cables tend to unwrap or separate from the cable drums; thereafter, when tension is restored, the lift cables may not relocate in the appropriate grooves or the appropriate relation to adjacent cable wraps. In some instances, a cable wrap will locate on a groove further inboard of the door from its original position so that as the door moves to the fully opened position, the cable drum runs out of grooves for cable wraps, such that the lift cable coils about parts of the drum that are not designed for cable storage. In this instance, if the lift cables dislodge from the cable storage drum and engage the smaller radius of the counterbalance system drive tube, the leverage effected by the springs is reduced such that the door will be extremely difficult or impossible to move. This is because the linear force between the door and the counterbalance springs relies on the leverage against the counterbalance spring being applied by the weight of the door operating through the radius of the cable storage drum rather than at a reduced radius portion of the cable drum or the drive tube for the counterbalance system.

In other instances, the removal of tension from the lift cables can result in cable wraps or coils being displaced to overlie existing cable wraps stored on the cable drum, which may cause the length of cable between the cable drums at opposite ends of a door to assume a different effective operating length. In such case, the door may be shifted angularly in the door opening, with the bottom edge of the door no longer paralleling the ground and the ends of the door sections moving out of a perpendicular orientation to the ground. If thus oriented, continued movement of the door can readily result in the door binding or jamming in the track system and, thus, being rendered inoperative.

In the instance of either of these operating anomalies occasioned by loss of tension in the lift cables, it is probable that the resultant tangling of the lift cables and/or jamming of the doors will prevent the door from further automatic or manual operation, leave the door in a partially open condition, and require qualified service personnel to repair damaged components and realign and assemble the door and counterbalance system components before the door is restored to normal operating condition.

There are a number of possible operating circumstances wherein tension in the lift cables of a counterbalance system for a sectional overhead door becomes reduced to such an extent that the lift cables may become mispositioned on or relative to the cable storage drums, thereby producing the problems discussed above. One example is when a door is rapidly raised from the closed to the open position at a velocity that is faster than the cable storage drums can rotationally react, such that slack is created in the lift cables. Another example is in the utilization of a motorized unit that turns the counterbalance system shaft to open and close a sectional overhead door, such as installations that employ what are termed in the trade as "jack-shaft operators". A jack-shaft may create cable slack when the operator turns the cable storage drum without the door moving, or the door is manually moved without actuating the cable storage drums.

The primary approach to preventing cable mispositioning has involved utilization of grooves in the circumference of the cable storage drums, which are otherwise present for positioning and spacing cable as it is taken up during the raising of a garage door. In some instances, exaggerated or deep grooves have been employed in the cable storage drums in an effort to maintain the lift cables appropriately positioned during a loss of tension on the lift cables. While the use of grooves so configured may be helpful in preventing lift cable mispositioning in minor losses of tension, this approach does not solve the commonly encountered problem of appreciable slack being created in the lift cables.

Another approach to avoid lift cable mispositioning in the event of the creation of cable slack is the use of cable slack take-up devices that compensate for cable slack when it occurs. A device of this type may employ a spring-loaded arm that displaces the cable in a controlled direction to take up any cable slack that might occur, with the controlled direction permitting proper repositioning of the lift cable on the cable storage drum once the slack is operationally eliminated. Normally, however, these designs will take up only minimal amounts of cable slack, and the cable take-up devices, if sensitive enough to be effective, impart a vague or detached component that derogates the desired positive drive positioning of the door during raising and lowering operations. These cable slack take-up devices also tend to require frequent adjustment as a function of component wear of the various components of the cable take-up device.

Another approach to eliminating the problem of cable slack in lift cables contemplates the use of an additional cable or cables connected to the top, as well as the conventional cables connected to the bottom, of a sectional overhead door to create what is sometimes referred to as a closed loop system, wherein the door is pulled open by one lift cable or cables and pulled closed by another cable or cables, with the cable storage drums for all of the cables being attached to the same counterbalance system drive shaft. Attempts to employ this closed loop system design results in the necessity for additional pulleys and hardware at substantial additional cost. In addition, the speed of the two points of attachment to the door are not uniform relative to the drive shaft, at least in areas where the top of the door is traversing the radius from the vertical to the horizontal storage position, while the bottom of the door is moving purely vertically. Such a speed differential requires compensation, such as a spring, which nonetheless may produce notable resistance to door motion. In some instances, the cables of a close loop system may contact the face of the door during a portion of the door travel, which can produce an unsightly mark on the face of the door that is visually apparent on the outside of the door when the door is in the closed position. Thus, no solution to cable slack in sectional overhead door systems having motor-driven counterbalance systems has achieved wide acceptance in the industry and, therefore, motor-driven counterbalance systems for sectional overhead doors have enjoyed only limited usage in the industry.

DISCLOSURE OF THE INVENTION

Therefore, an object of the present invention is to provide a cable control device for a motor-driven counterbalance system for a sectional overhead door that accommodates slack developed in a lift cable without attendant mispositioning of the lift cable on the cable storage drums when tension in the lift cables is restored. Another object of the present invention is to provide such a cable control device in the form of a retainer associated with the cable drums for engaging a portion of at least one cable wrap or coil in such a manner as to prevent displacement of a portion of the cable wrap from engagement with the cable drums. A further object of the present invention is to provide such a cable control device wherein one embodiment employs a retainer that engages a circumferential portion of each of the cable wraps to thereby positively prevent displacement of each of the cable wraps from engagement with the cable drums, which could produce mispositioning of a lift cable when tension is restored.

Another object of the present invention is to provide a cable control device for a motor-driven counterbalance system for a sectional overhead door by providing a cable retainer or snubber that solves a primary problem associated with the utilization of jack shaft operators in conjunction with overhead sectional garage door systems. Yet another object of the invention is to provide such a cable control device that does not require modification or supplemental structure being implemented with respect to the drive motor or counterbalance system, other than a minor modification with respect to the cable storage drums. Still a further object of the invention is to provide such a cable control device that eliminates or greatly reduces the possibilities of cable tangling, jamming, and/or door misalignment, which can result in a door being inoperative in an open position and in a condition requiring qualified service personnel and/or replacement parts to return the door to its normal operating condition. Yet a further object of the invention is to provide such a cable control device that, in one embodiment, requires only a single part attached to the cable storage drum and, in the instance of an alternate embodiment, requires no additional component parts but merely modification to the cable storage drum.

Still another object of the present invention is to provide a cable control device for a motor-driven counterbalance system for a sectional overhead door that may employ a cable storage drum having conventional guide grooves, without the necessity for employing a special cable storage drum having specially configured grooves or like structure, which does not solve the problem of cable mispositioning in the event of substantial temporary cable slack in the operation of such a sectional overhead door. Still another object of the invention is to provide such a cable control device that does not require the incorporation of springs in the lift cables, the presence of attachments to the lift cables, and/or the utilization of a special type of lift cable.

Still another object of the present invention is to provide a cable control device for a motor-driven counterbalance system for a sectional overhead door wherein no moving parts are employed that may require adjustment, can be damaged, and/or can become jammed, thereby negating their normal functioning. Yet a further object of the invention is to provide such a cable control device that does not require additional cables, pulleys, or any other hardware. Still another object of the present invention is to provide such a cable control device that does not affect the counterbalance system or alter its operational performance in a manner that could produce adverse effects on the operation of the door. Still another object of the invention is to provide such a cable control device that is inexpensive, requires no service, and can readily be retrofitted to existing motor-driven counterbalance systems.

In general, the present invention contemplates a cable control device for a sectional overhead door having a motor-driven counterbalance system including, a spring-loaded drive shaft, cable drums carried by the drive shaft, cables attached to and interconnecting the cable drums and the door and forming and releasing cable wraps on the cable drums upon raising and lowering of the door, and retainers associated with the cable drums engaging a portion of at least one cable wrap to maintain engagement of the cable wrap with the cable drums in the event of the development of slack in the cables.

PREFERRED EMBODIMENT FOR CARRYING OUT THE INVENTION

Figure 1:
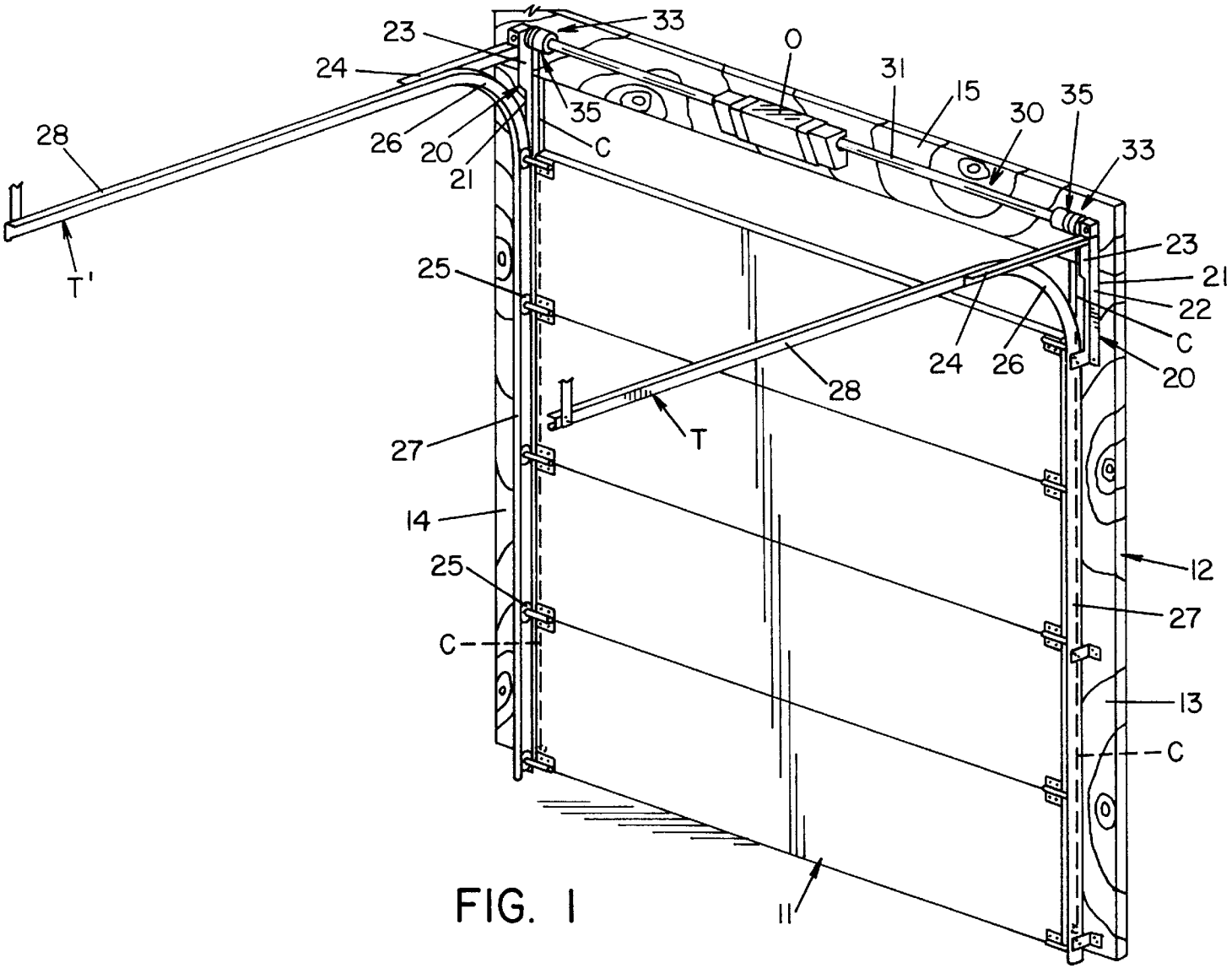
FIG. 1 is a perspective view of an exemplary motor-driven counterbalance system and sectional overhead door that incorporates a cable control device according to the concepts of the present invention.
Figure 2:
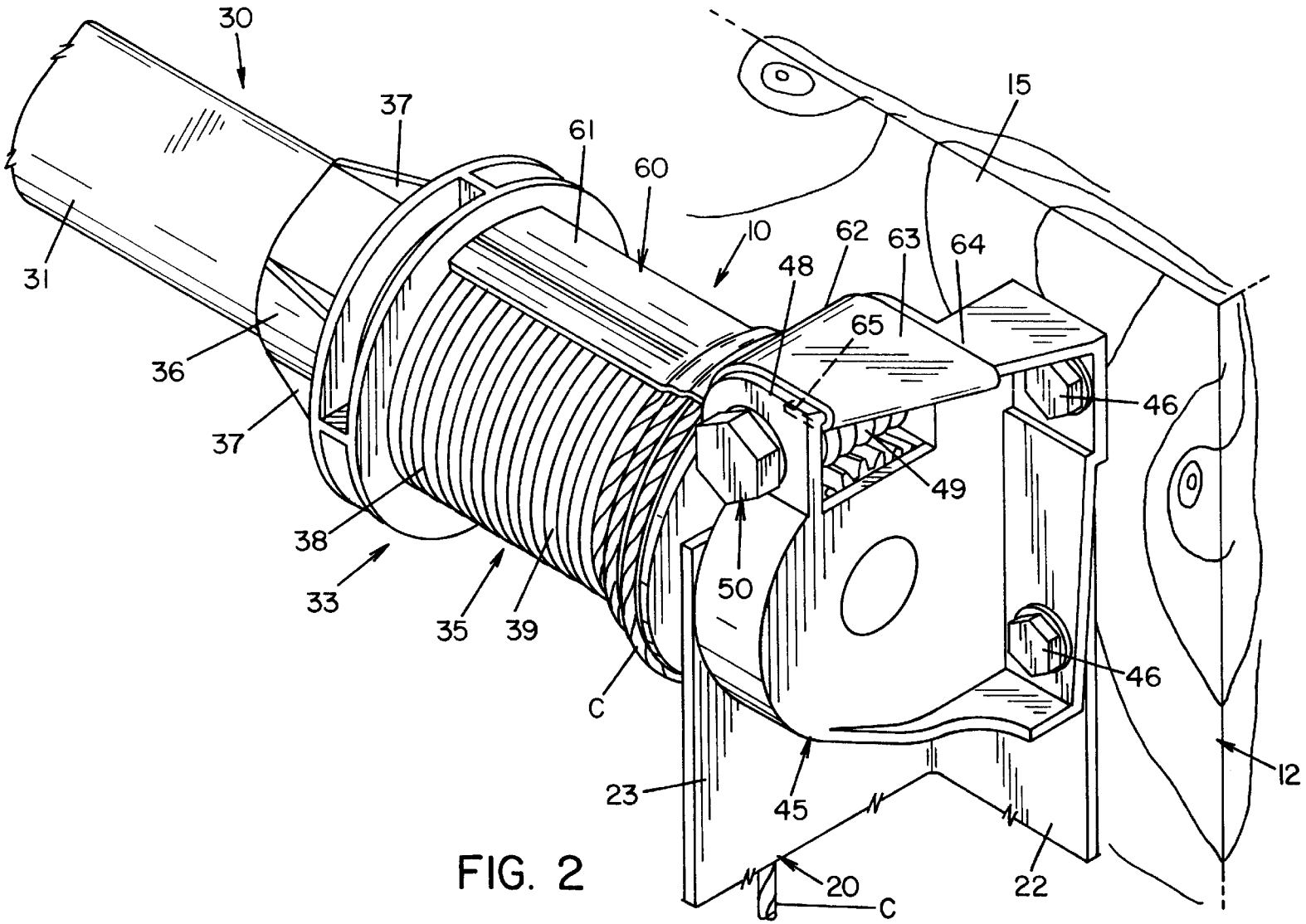
FIG. 2 is an enlarged fragmentary perspective view depicting the cable drum portion of the motor-driven counterbalance system and the interrelation with a cable control device of the present invention.
Figure 3:
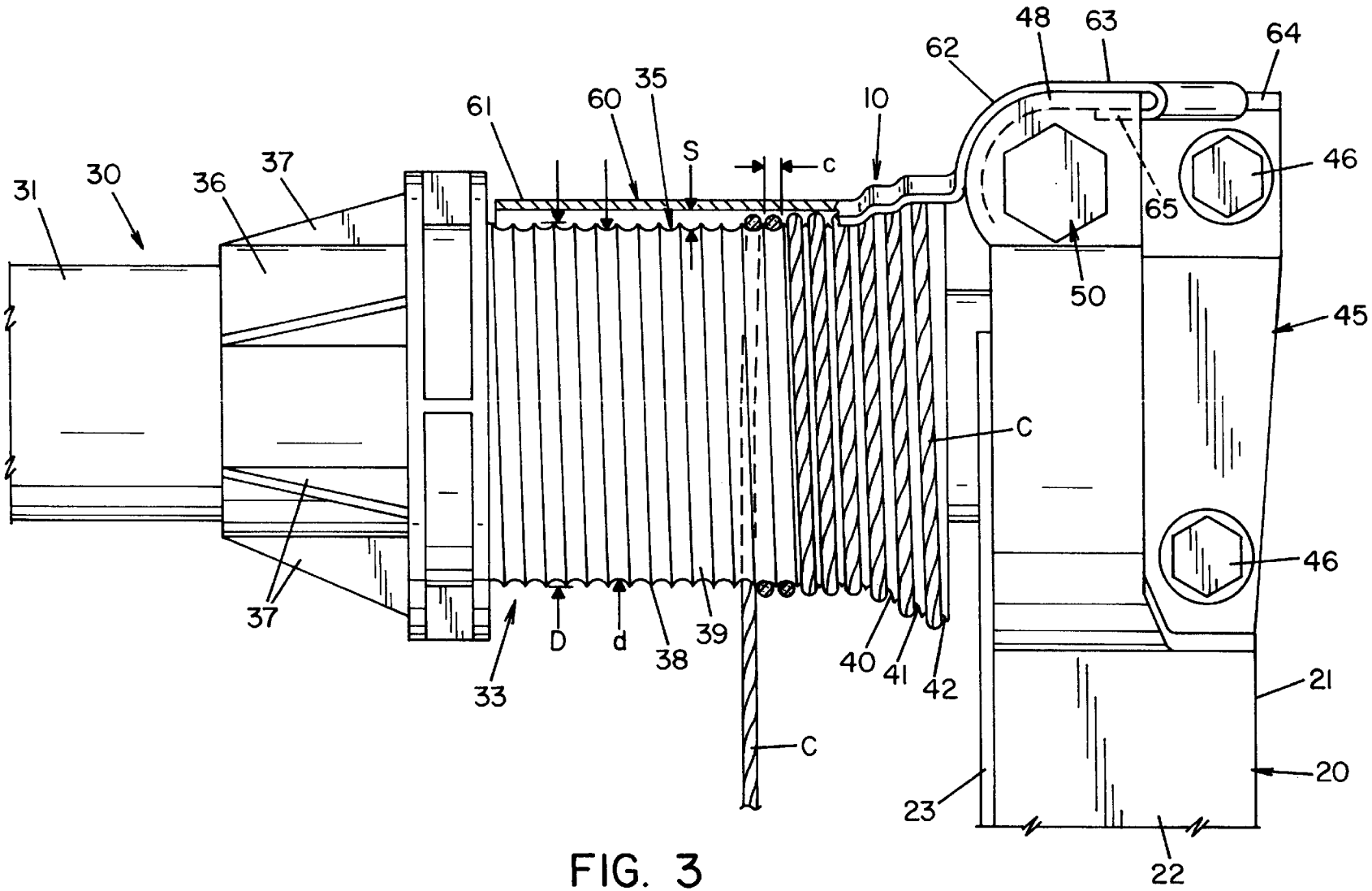
FIG. 3 is an elevational view, partially in section, showing details of a cable control device in operative position in relation to the cable drum of a motor-driven counterbalance system for a sectional overhead door.

A cable control mechanism according to the concepts of the present invention is generally indicated by the numeral 10 in FIGS. 2 and 3 of the drawings. Referring to FIG. 1 of the drawings, the cable control device 10 is shown mounted in conjunction with a conventional sectional door 11 of a type commonly employed in garages for residential housing. The opening in which the door 11 is positioned for opening and closing movements relative thereto is defined by a frame, generally indicated by the numeral 12, that consists of a pair of spaced jambs 13, 14 that, as seen in FIG. 1, are generally parallel and extend vertically upwardly from the floor (not shown). The jambs 13, 14 are spaced and joined at their vertically upper extremity by a header 15 to thereby delineate a generally inverted U-shaped frame 12 around the opening for the door 11. The frame 12 is normally constructed of lumber, as is well known to persons skilled in the art, for the purposes of reinforcement and facilitating the attachment of elements supporting and controlling door 11.

Affixed to the jambs 13, 14 proximate the upper extremities thereof and the lateral extremities of the header 15 to either side of the door 11 are flag angles, generally indicated by the numeral 20. The flag angles 20 generally consist of L-shaped vertical leg members 21 having a leg 22 attached to underlying jambs 13, 14 and a projecting leg 23 preferably disposed substantially perpendicular to the leg 22 and, therefore, perpendicular to the jambs 13, 14.

Conventional angle irons 24 are positioned in supporting relation to tracks T, T' located to either side of door 11. The tracks T, T' provide a guide system for rollers 25 attached to the side of door 11, in a manner well known to persons skilled in the art. The angle irons 24 normally extend substantially perpendicular to the jambs 13, 14 and may be attached to a transitional portion 26 of tracks T, T' between a vertical section 27 and a horizontal section 28 thereof or to horizontal section 28 of tracks T, T'.The tracks T, T' define the travel of the door 11 in moving upwardly from the closed to open position and downwardly from the open to closed position.

Still referring to FIGS. 1 of the drawings, door 11 has a counterbalance system, generally indicated by the numeral 30. As shown, the counterbalance system 30 includes an elongate drive tube 31 extending between cable drum mechanisms 33 positioned proximate each of the flag angles 20. While the exemplary counterbalance system 30 depicted herein is advantageously in accordance with U.S. Pat. No. 5,419,010, which is incorporated herein by reference, it will be appreciated by persons skilled in the art that any of a variety of torsion-spring counterbalance systems could be employed. In any instance, the counterbalance system 30 includes cable drum mechanisms 33 positioned on the drive tube 31 or a shaft proximate the ends thereof which rotate with drive tube 31. The cable drum mechanisms 33 each have a cable C reeved thereabout which is affixed to the door 11 preferably proximate the bottom, such that rotation of the cable drum mechanisms 33 operates to open or close the door 11. The cable C may be attached to a substantially cylindrical drum 35 of cable drum mechanism 33 in the manner described in the aforesaid U.S. Pat. No. 5,419,010. The cable C is preferably a conventional stranded steel cable, which may be coated and, due to its memory characteristics, has a tendency to resist bending in the absence of tension forces acting thereon. The counterbalance system 30 has an operator O, which may conveniently enclose a length of the drive tube 31, as shown, or be a typical jack-shaft operator connected by gears, pulleys, or the like to selectively rotatably power the drive tube 31 or a shaft in a manner well known to persons skilled in the art.

The cable drum 35 of cable drum mechanism 33 has at its inboard end a sleeve 36 having a plurality of circumferentially-spaced, tapered reinforcing ribs 37. The end of drum 35 opposite the sleeve 36 is proximate to the leg 22 of flag angles 20. The drum 35 has a substantially cylindrical outer surface 38 over a substantial portion of its axial length. The drum 35 is provided with continuous helical grooves 39 over the outer surface 38 thereof. The outboard end of drum 35 proximate flag angle 20 may have a plurality of raised grooves 40, 41, and 42 which are of increasing minor diameter.

Counterbalance system 30 has on the outboard side of flag angle 20 an end bracket, generally indicated by the numeral 45, to effect attachment to the flag angle 20 and/or the jamb 12, as by screws 46 or other suitable fasteners. The end bracket 45 includes a worm shroud 48 which encloses a worm 49 (see FIG. 2) of a tension adjusting mechanism, generally indicated by the numeral 50.

The cable control mechanism 10 is shown in operative relation to counterbalance system 30 in FIGS. 2 and 3 of the drawings. The cable control mechanism 10 consists of a cable retainer 60, which may be a shaped piece of metal or plastic that is selectively displaced from the cylindrical outer surface 38 of the drum 35. A primary operative portion of the cable retainer 60 is a hood 61 that is of an arcuate configuration that preferably extends substantially the entire axial extent of the helical grooves 39 on the drum 35. The arcuate extent of the hood 61 is preferably such that the hood 61 extends through a circumferential arc of the drum 35 amounting to approximately 10 to 30 degrees, which provides for contact with a coil or wrap of the cable C at any time slack is created in cable C. This precludes cable C from disengaging or becoming spaced from drum 35 at one or more loops due to this configuration of the hood 61. Since the hood 61 is fixed and thus configured, the development of slack due to loss of tension in cable C produces a loop in cable C outwardly of the hood 61 that positions the cable C in its appropriate helical groove 39 on cable drum 35 when tension is reestablished.

The positioning of cable C is normally optimally effected by locating the hood 61 relative to the drum 35 at a space S that will allow only a single loop of cable C to repose in each of the grooves 39, 40 in drum 35 (FIG. 3). The hood 61, if subtending an arc of a circle centered about the axis of drum 35, will have a uniform space S between it and the minor diameter d of the grooves about its entire circumferential extent. If hood 61 is a different curvature, the minimum proximity to the grooves 39, 40 of drum 35 should be the space S. It has been empirically determined that the space S is preferably defined as 60 to 80 percent of $$\frac{D-d}{2}+c,$$

where D is the major diameter of the grooves in the cable storage drum; d is the minor diameter of the grooves in the cable storage drum; and c is the diameter of the cable C. The relation of the hood 61 to the drum 35 should, in any instance, be configured to absolutely preclude any overlap of the wraps of cable C while avoiding undue friction between the wraps of cable C and hood 61.

The cable retainer 60 is mounted in fixed relation to the rotating drum 35 to carry out the above-described function. While the cable retainer 60 might be attached to an adjacent portion of the jamb 12, the desired precise positioning of hood 61 may be more readily accomplished by attachment to the end bracket 45. As seen in FIGS. 2 and 3 of the drawings, the cable retainer 60 is depicted mounted on the worm shroud 48 of end bracket 45. Extending from the hood 61 is a curved leg 62 that overlies and parallels the configuration of worm shroud 48. The curved leg 62 merges into a flat leg 63, which overlies a brace 64 (see FIG. 2) of the end bracket 45. The flat leg 63 merges into a return leg 65, which underlies and captures the brace 64 of end bracket 45. The return leg 65 may be inwardly and upwardly biased to enhance frictional engagement with the brace 64 so as to operate in the manner of a clamping spring clip. If desired, one or more fasteners (not shown) may be inserted through one or more of the legs 62, 63, and 65 and into brace 64 or worm shroud 48 to maintain hood 61 of cable retainer 60 in the desired position in the event of application of abnormal forces to the cable retainer 60. It will thus be appreciated that once mounted on worm shroud 48, the cable retainer 60 will retain its desired positioning during operation without the necessity for repositioning, adjustment, or other maintenance.

Figure 4:
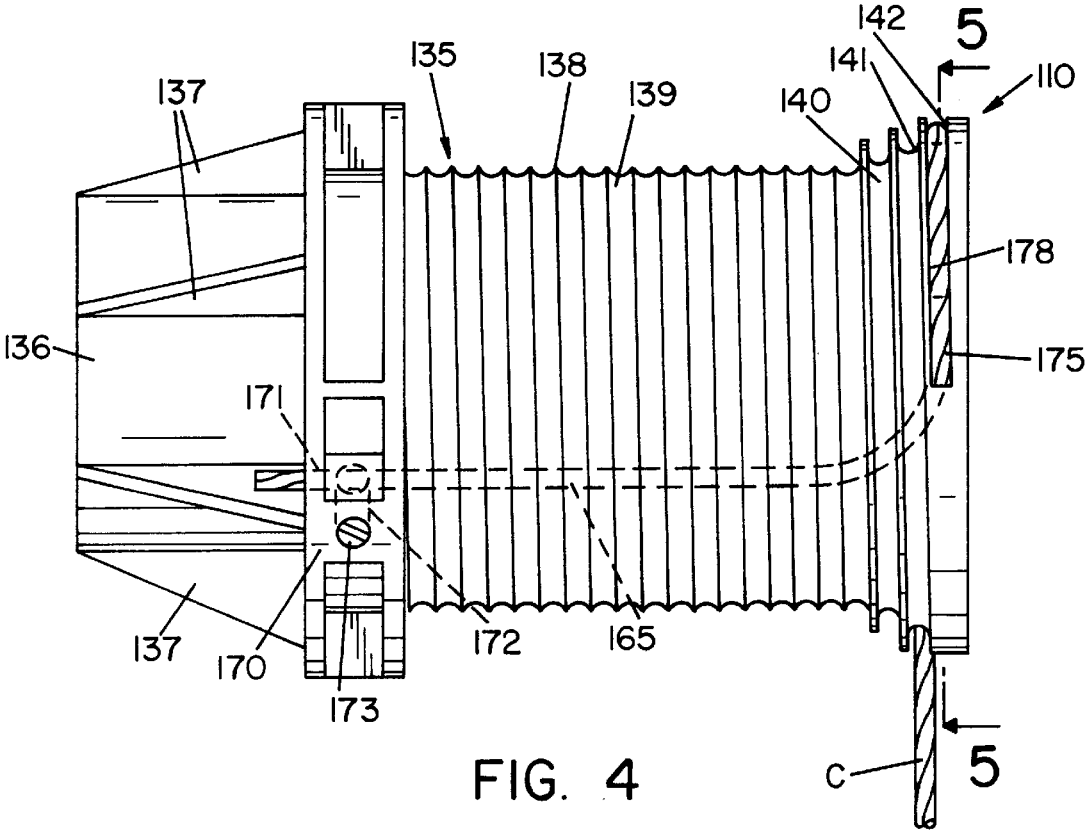
FIG. 4 is an elevational view of an alternate form of cable control device depicted in conjunction with a cable drum of a motor-driven counterbalance system for a sectional overhead door of the type depicted in FIG. 1 of the drawings.
Figure 5:
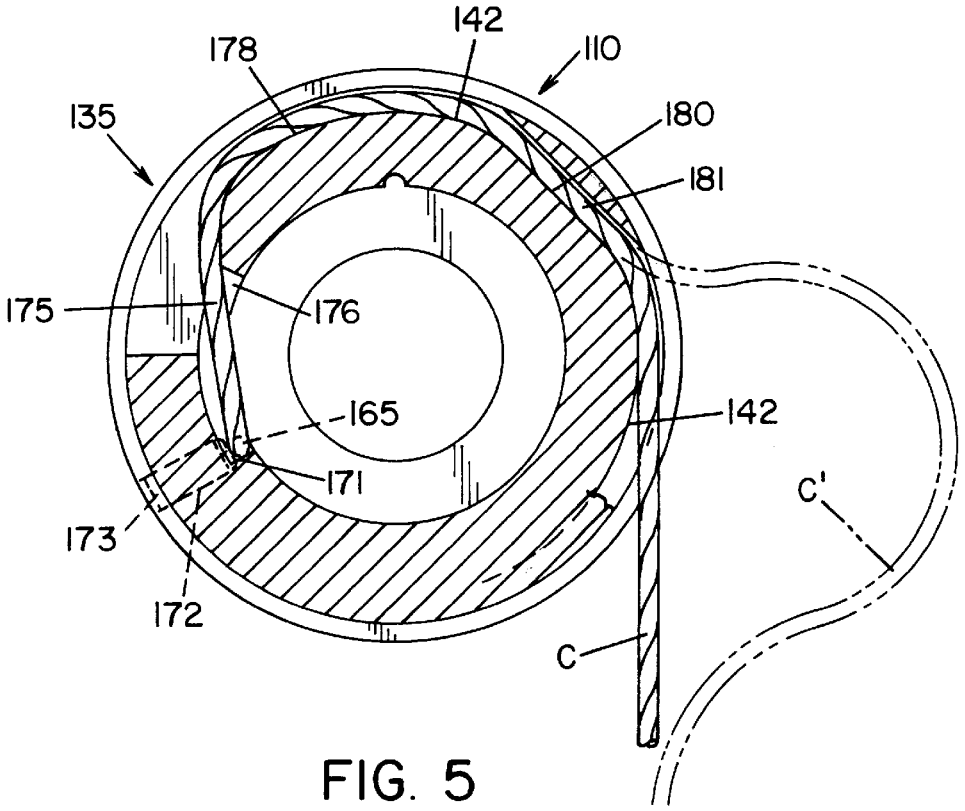
FIG. 5 is a sectional view taken substantially along the line 5—5 of FIG. 4 of the alternate form of cable control device showing details of the modified form of cable control device of FIG. 4 in relation to the cable drum.

An alternate form of cable control mechanism is generally indicated by the numeral 110, in FIGS. 4 and 5 of the drawings. In the instance of cable control mechanism 110, the entire counterbalance system is identical to counterbalance system 30 described hereinabove, except that the cable drum 35 is replaced by a modified cable drum 135. The cable drum 135 may be provided with a sleeve 136 having a plurality of circumferentially-spaced, tapered reinforcing ribs 137. The cable drum 135 may also have an outer surface 138 provided with continuous helical grooves 139 over a substantial portion of its axial length. The outboard end of cable drum 135 may also have a plurality of raised grooves 140, 141, and 142 that are of progressively increasing minor diameter.

The cable C may be secured to the drum 135 in the manner employed in conjunction with prior U.S. Pat. No. 5,419,010. As shown in FIGS. 4 and 5, the cable C has an axial segment 165 that is located interiorly of the drum 135 and extends axially through an inboard flange 170 and particularly a channel 171 therein. The inboard flange 170 also has a tapped bore 172 that intersects the channel 171. A set screw 173 operates in the tapped bore 172 to selectively retentively engage axial segment 165 of cable C at a desired position. A preferred position in terms of the position of drum 135 for the door 11 in the closed position is depicted in FIGS. 4 and 5.

At the end of cable drum 135 opposite inboard flange 170, the axial segment 165 of cable C terminates in a somewhat radially angularly disposed radial segment 175 of the cable C, which extends through a cut out 176 in the cable drum 135. The cable C extends from the radial segment 175 to a groove segment 178 that lies in the raised groove 142 of the cable drum 135. To this point, the cable positioning relative to cable drum 135 is in accordance with that employed in U.S. Pat. No. 5,419,010.

Interconnection of cable C with cable drum 135 differs in that subsequent to raised groove 142, the cable drum 135 has a tunneled channel 180 that extends between two spaced locations on the raised groove 142. As shown, the tunneled channel 180 may be substantially linear and extend a distance of approximately 25 to 60 degrees relative to the center line of the cable drum 135. Cable C has a tunnel segment 181 that lies within the tunneled channel 180. For purposes that will become apparent hereinafter, the tunnel channel emerges from the drum 135 at a location such that cable C extends substantially tangentially directly downward to where it is attached to the door 11 in conventional fashion when the door is in the fully closed position. Thus, should the door be raised without actuation of the operator O, as in the event of a forced entry, the cable C that, due to the groove segment 178 and tunnel segment 181, tends to form a cable loop C' substantially co-planar with raised grooves 142 and 141, such that upon release of the door 11 or actuation of operator O, the cable loop C' is repositioned in a normal position in raised grooves 142, 141 of the cable drum 135. Thus, the tunneled channel 180 operates as a retainer in engaging a portion of the cable wrap in grooves 142, 141 to prevent displacement of the cable C to any substantial extent that would prevent appropriate repositioning subsequent to the development of slack in the cable C when the cable C forms a cable loop C' as when the door 11 might be temporarily manually raised a distance from the closed vertical position.

The tunneled channel 180 should be of a diameter only slightly larger than the outside diameter of the cable C and be of a sufficient length such that cable C is not moved in tunneled channel 180 when a cable loop C' is formed in the cable C. That is, the tunnel segment 181 of cable C should not move within tunneled channel 180 when a cable loop C' is formed in cable C in the manner depicted in FIG. 5 of the drawings. The length of the tunneled channel 180 may also be advantageously varied, depending upon the flexure characteristics of the cable C. In this respect, a shorter tunneled channel 180 may suffice for relatively less flexible cable, whereas a longer tunneled channel 180 may be required for more flexible cable. It is also to be appreciated that cable memory is a factor, with the cable C being normally reeved about the drum 135, being displaced to form cable loop C' relative to spaced groove 142, and subsequently resuming its reeved position upon groove 142 and the remainder of the cable drum 135.

Thus, it should be evident that the cable control device for sectional overhead door disclosed herein carries out one or more of the objects of the present invention set forth above and otherwise constitutes an advantageous contribution to the art. As will be apparent to persons skilled in the art, modifications can be made to the preferred embodiments disclosed herein without departing from the spirit of the invention, the scope of the invention herein being limited solely by the scope of the attached claims.

What is claimed is:

1. A cable control device in a sectional overhead door having a motor-driven counterbalance system comprising, a spring-loaded drive shaft, cable drums having cable grooves and carried by said drive shaft, end brackets of said counterbalance system for mounting said drive shaft, cables attached to and interconnecting said cable drums and the door and forming and releasing cable wraps of said cable in said cable grooves of said cable drums upon raising and lowering of the door, and cable retainers associated with said cable drums, said cable retainers having legs which fixedly mount said cable retainers on said end brackets and having arcuate hoods extending axially of said cable drums over said grooves and through a circumferential are of said cable drums of approximately 10 to 30 degrees, with at least a portion of said retainers spaced in close radial proximity to said cable grooves for engaging a portion of at least one of said cable wraps to maintain engagement of said cable wrap with said cable drums in the event of the development of slack in said cables.

2. A cable control device according to claim 1, wherein said cable grooves are positioned along an axial extent of an outer circumferential surface of said cable drums and are in a helical configuration.

3. A cable control device according to claim 1, wherein said hoods are positioned sufficiently close to said cable grooves such as to preclude overlapping of said cable wraps.

4. A cable control device in a sectional overhead door having a motor-driven counterbalance system comprising, a spring-loaded drive shaft, cable drums carried by said drive shaft, cables attached to and interconnecting said cable drums and the door and forming and releasing cable wraps of said cable on said cable drums upon raising and lowering of the door, and cable retainers associated with said cable drums engaging a portion of at least one of said cable wraps to maintain engagement of said cable wrap with said cable drums in the event of the development of slack in said cables, wherein said cable has a diameter, said cable retainers including a hood which overlays said cable wraps, each of said cable drums having grooves on the outer circumferential surface thereof having a minor diameter and a major diameter and said hood is displaced from said minor diameter of said grooves by 60 to 80 percent of the difference between one half said major diameter of said grooves less than one half said minor diameter of said grooves plus said outside diameter of said cables.

5. A cable control device in a sectional overhead door having a motor-driven counterbalance system comprising, a spring-loaded drive shaft, a pair of cable drums having cable grooves in the surface thereof and carried by said drive shaft, cables attached to and interconnecting said cable drums and the door, and forming and releasing cable wraps of said cable in said cable grooves of said cable drums upon raising and lowering of the door, radial segments of said cables extending through a cut-out in said cable drums, groove segments of said cables connected to said radial segments and lying in one of said cable grooves, a channel in each of said cable drums extending through said cable drums between two circumferentially spaced points on said one of said cable grooves, said cables having tunnel segments connected to said groove segments and extending through said channels to connect said cables to said cable drums and to maintain said cable in proximity to said cable drums co-planar with said one of said cable grooves in the event of the development of slack in said cable, whereby retensioning of said cable repositions said cable in said one of said cable grooves.

6. A cable control device according to claim 5, wherein said circumferentially spaced points on said one of said cable grooves of said cable drums are displaced through an angle of approximately 25 to 60 degrees.

7. A cable control device according to claim 5, wherein said channels frictionally engage said cables such that said tunnel segments of said cables do not move relative to said channels during the development of slack in said cables.

* * * * *

UNITED STATES PATENT AND TRADEMARK OFFICE

CERTIFICATE OF CORRECTION

PATENT NO. : 6,164,014 
DATED : December 26, 2000
INVENTOR(S) : Allen C. McDowell and Willis J. Mullet It is certified that error appears in the above-identified patent and that said Letters Patent is hereby corrected as shown below:

Column 8,
Line 65, the word "are" should be -- arc --.

Signed and Sealed this

Fifth Day of July, 2005

JON W. DUDAS
*Director of the United States Patent and Trademark Office*